US007069208B2

(12) United States Patent
Wang

(10) Patent No.: US 7,069,208 B2
(45) Date of Patent: Jun. 27, 2006

(54) SYSTEM AND METHOD FOR CONCEALMENT OF DATA LOSS IN DIGITAL AUDIO TRANSMISSION

(75) Inventor: Ye Wang, Tampere (FI)

(73) Assignee: Nokia, Corp., Espoo (FI)

( * ) Notice: Subject to any disclaimer, the term of this patent is extended or adjusted under 35 U.S.C. 154(b) by 819 days.

(21) Appl. No.: 09/770,113

(22) Filed: Jan. 24, 2001

(65) Prior Publication Data

US 2002/0133764 A1 Sep. 19, 2002

(51) Int. Cl.
*G10L 19/14* (2006.01)

(52) U.S. Cl. ..... 704/211; 704/503; 704/228; 725/36

(58) Field of Classification Search ..... 704/211, 704/503, 228; 725/36
See application file for complete search history.

(56) References Cited

U.S. PATENT DOCUMENTS

| | | | | |
|---|---|---|---|---|
| 5,040,217 | A | 8/1991 | Brandenburg et al. | |
| 5,148,487 | A | 9/1992 | Nagai et al. | |
| 5,256,832 | A * | 10/1993 | Miyake | 84/636 |
| 5,285,498 | A | 2/1994 | Johnston | |
| 5,361,278 | A * | 11/1994 | Vaupel et al. | 375/240 |
| 5,394,473 | A | 2/1995 | Davidson | |
| 5,481,614 | A | 1/1996 | Johnston | |
| 5,579,430 | A | 11/1996 | Grill et al. | |
| 5,636,276 | A | 6/1997 | Brugger | |
| 5,841,979 | A | 11/1998 | Schulhof et al. | |
| 5,852,805 | A * | 12/1998 | Hiratsuka et al. | 704/500 |
| 5,875,257 | A | 2/1999 | Marrin et al. | |
| 5,928,330 | A | 7/1999 | Goetz et al. | |
| 6,005,658 | A | 12/1999 | Kaluza et al. | |
| 6,064,954 | A * | 5/2000 | Cohen et al. | 704/207 |
| 6,115,689 | A | 9/2000 | Malvar | |
| 6,125,348 | A | 9/2000 | Levine | |
| 6,141,637 | A | 10/2000 | Kondo | |
| 6,175,632 | B1 | 1/2001 | Marx | |
| 6,199,039 | B1 * | 3/2001 | Chen et al. | 704/229 |
| 6,287,258 | B1 | 9/2001 | Phillips | |
| 6,305,943 | B1 | 10/2001 | Pougatchev et al. | |
| 6,453,282 | B1 * | 9/2002 | Hilpert et al. | 704/200.1 |
| 6,477,150 | B1 | 11/2002 | Maggenti et al. | |
| 6,597,961 | B1 | 7/2003 | Cooke | |
| 6,738,524 | B1 | 5/2004 | de Queiroz | |
| 6,787,689 | B1 | 9/2004 | Chen | |
| 6,807,526 | B1 | 10/2004 | Touimi et al. | |

FOREIGN PATENT DOCUMENTS

| | | |
|---|---|---|
| DE | 197 36 669 | 10/1998 |
| EP | 0 703 712 A2 | 3/1996 |
| EP | 0 718 982 A2 | 6/1996 |
| EP | 1 207 519 | 5/2002 |
| WO | WO 93/26099 | 6/1993 |
| WO | WO 98/13965 | 4/1998 |

OTHER PUBLICATIONS

Goto Masataka, et al., "Beat Tracking based on Multiple-agent Architecture–A Real–Time Beat Tracking System for Audio Signals," pp. 103–110, 1996.

(Continued)

*Primary Examiner*—David L. Ometz
*Assistant Examiner*—Jakieda R Jackson
(74) *Attorney, Agent, or Firm*—Banner & Witcoff, Ltd.

(57) ABSTRACT

A system and method for the concealment of errors resulting from missing or corrupted data in the transmission of audio signals in compressed digital packet formats is disclosed. The system utilizes a circular FIFO buffer to store audio frames from the transmitted audio signal, and a beat detector, to identify the presence of beats in the audio signal. The error concealment method replaces erroneous audio frames with error-free audio frames by a process which takes into account the presence and location of the detected beats.

42 Claims, 15 Drawing Sheets

OTHER PUBLICATIONS

Scheirer, Eric D., "Tempo and Beat Analysis of Acoustic Music Signals", J. Acoust Soc. Am. 103 (1), Jan. 1998, pp. 588–601.
Davis Pan, "A Tutorial on MPEG/Audio Compression," IEEE Multimedia, pp. 60–74, (Summer 1995).
Yajnik, M. et al., "Packet Loss Correlation in the Mbone Multicast Network", Proc. IEEE Global Internet Conference, Nov. 1996.
Carle, G. et al., "Survey of Error Recovery Techniques for IP–Based Audio–Visual Multicast Applications", IEEE Network, Nov./Dec. 1997.
Jayant, N.S et al., "Effects of Packet Losses in Waveform Coded Speech and Improvements due to an Odd–Even Sample Interpolation Procedure", IEEE Trans. Commun., vol. COM–29, No. 2, Feb. 1981, pp. 101–109.
Herre, J. et al., Extending the MPEG–4AAC Codec by Perceptual Noise Substitution, $104^{th}$ AES Convention, Amsterdam 1998, preprint 4720.
Y. Wang et al., "On The Relationship Between MDCT, SDFT and DFT", WCC 2000—ISCP 2000, Aug. 21–25, 2000, pp. 44–47.
Y. Wang et al., "A Compressd Domain Best Detector Using MP3 Audio Bitstreams", Proceedings Of The ACM International Multimedia Conference And Exhibition 2001, ACM Multimedia 2001 Workshops, Sep. 30, 2001, pp. 194–202.
Y. Wang, "A Beat–Pattern based Error Concealment Scheme for Music Delivery with Burst Packet Loss", 2001 IEEE International Conference on Multimedia and Expo, ICME 2001, Aug. 22–25, 2001, pp. 73–76.
Bosse, Modified Discrete Cosine Tranform (MDCT), Mar. 7, 1998, available at http://ccma–www.standford.edu/bosse/proj/node27.html.
Fraunhofer, MPEG Audio Layer–3, available at http://www.lis.fhg.de/amm/techint/layer3/index.html.
WCDMAN—the wideband 'radio pipe' for 3G services, Sep. 17, 1999, available at http://www.ericsson.com/wireless/productsys/gsm/subpages/umts_and_3g/wcdman.shtml.
GSM Frequently Asked Questions, Oct. 23, 2000, available at http://www.gsmworld.com/technology/faw.html.
Perkins, Hodson, Options for Repair of Streaming Media, Network Working Group RFC 2354, The Internet Society, Jun. 1998.
Wang, Y., Vilermo, M., Isherwood, D. "The Impact of the Relationship Between MDCT and DFT on Audio Compression: A Step Towards Solvign the Mismatch", the First IEEE Pacific–Rim Conference on Multimedia (IEEE PCM2000), Dec. 13–15, 2000, Sydney, Australia, pp. 130–138.
Perkins, C., Hodson, O., Hardman, V., "A Survey of Packet–loss Recovery Techniques for Streaming Audio," IEEE Network, Sep./Oct. 1998.
ETSI Rec. GSM 6.11, "Substitution and Muting of Lost Frames for Full Rate Speech Signals," 1992.
Goodman, O.J. et al., "Waveform Substitution Techniques for Recovering Missing Speech Segments in Packet Voice Communications," IEEE Trans. Acoustics, Speech, and Sig. Processing, vol. ASSP–34, No. 6, Dec. 1986, pp. 1440–1448.
Wasem, O.J. et al., "The Effects of Waveform Substitution on the Quality of PCM Packet Communications," IEEE Trans. Acoustics, Speech, and Sig. Processing, vol. 36, No. 3, Mar. 1988, pp. 342–348.
Sanneck, H. et al., "A New Technique for Audio Packet Loss Concealment," IEEE Global Internet 1996, Dec. 1996 pp. 48–52.
Chen, Y.L., Chen, B.S., "Model–based Multirate Representation of Speech Signals and its Applications to Recovery of Missing Speech Packets," IEEE Trans. Speech and Audio Processing, vol. 15, No. 3, May 1997, pp. 220–231.
Herre et al, Evaluation of Concealment Techniques for Compressed Digital Audio, Audio Engineering Society Preprint, Mar. 16–19, 1993, Preprint 3460 (A1–4), Erlangen, Germany.
Bolot et al, Analysis of Audio Packet Loss in the Internet, Proc. of 5th Int. Workshop on Network and Operating System Support for Digital, Audio and Video, pp. 163–174, Durham, Apr. 1995.
International Standard ISO/IEC, Information Technology—Coding of Moving Pictures and Associated Audio for Digital Storage Media at up to About 1,5 Mbit/s—Part 3, Audio, Technical Corrigendum 1, Published Apr. 15, 1996, Re f. No. ISO/IEC 11172–3:1993/Cor.1:1996(E)Printed in Switzerland.
Stenger et al, A New Error Concealment Technique for Audio Transmission with Packet Loss, Telecommunications Institute, University of Erlangen–Nuremberg, Cauerstrasse 7, 91058 Erlangen, Germany, Eusipco 1996.
Goto et al, A Real–Time Music Scene Description System: Detecting Melody and Bass Lines in Audio Signals, Machine Understanding Divsion, Electrotechnical Laboratory 1–1–4 Umezono, Tsukuba, Ibaraki 305–8586 Japan, Working Notes of the IJCAI–99 Workshop on Computational Auditory Scene Analysis, pp. 31–40, Aug. 1999.
McKinley et al, Experimental Evaluation of Forward Error Correction on Multicast Audio Streams in Wireless LANs, Department of Computer Science and Engineering, Michigan State University, East Lansing, MIchigan 48824, pp 1–10, Copyright 2000 ACM.
Nishihara et al, A Practical Query–By–Humming System for a Large music Database, NTT Laboratores, 1–1, Hikarinooka, Yokosuka–shi, Kanagawa, 239–0847, Japan, pp 1–38.
Malvar, "Biothogonal and Nonuniform Lapped Transform Coding with Reduced Blocking and Ringing Artifacts", IEEE Transactions on Signal Processing, col. 46, Issue 4, Apr. 1998. pp. 1043–1053.

* cited by examiner

SYSTEM AND METHOD FOR CONCEALMENT OF DATA LOSS IN DIGITAL AUDIO TRANSMISSION

FIELD OF THE INVENTION

This invention relates to the reception of digital audio signals and, in particular, to a system and method for concealment of transmission errors occurring in digital audio streaming applications.

BACKGROUND OF THE INVENTION

The transmission of audio signals in compressed digital packet formats, such as MP3, has revolutionized the process of music distribution. Recent developments in this field have made possible the reception of streaming digital audio with handheld network communication devices, for example. However, with the increase in network traffic, there is often a loss of audio packets because of either congestion or excessive delay in the packet network, such as may occur in a best-effort based IP network.

Under severe conditions, for example, errors resulting from burst packet loss may occur which are beyond the capability of a conventional channel-coding correction method, particularly in wireless networks such as GSM, WCDMA or BLUETOOTH. Under such conditions, sound quality may be improved by the application of an error-concealment algorithm. Error concealment is an important process used to improve the quality of service (QoS) when a compressed audio bit stream is transmitted over an error-prone channel, such as found in mobile network communications and in digital audio broadcasts.

Perceptual audio codecs, such as MPEG-1 Layer III Audio Coding (MP3), as specified in the International Standard ISO/IEC 11172-3 entitled "Information technology of moving pictures and associated audio for digital storage media at up to about 1,5 Mbits/s—Part 3: Audio," and MPEG-2/4 Advanced Audio Coding (AAC), use frame-wise compression of audio signals, the resulting compressed bit stream then being transmitted over the audio packet network.

One method of decoding and segment-oriented error concealment, as applied to MPEG1 Layer II audio bitstreams, is disclosed in international patent publication WO98/13965. In the reference, decoding is carried out in stages so that the correctness of the current frame is examined and possible errors are concealed using corresponding data of other frames in the window. Detection of errors is based on the allowed values of bit combinations in certain parts of the frame. For an MP3 transmission, the frame length refers to the audio coding frame length, or 576 pulse code modulation (PCM) samples for a frame in one channel. The frame length is approximately thirteen msec for a sampling rate of 44.1 KHz.

Conventional error detection and concealment systems operate with the assumption that the audio signals are stationary. Thus, if the lost or distorted portion of the audio signal includes a short transient signal, such as a 'beat,' the conventional system will not be able to recover the signal.

What is needed is an audio data decoding and error concealment system and method which can mitigate the degradation of the audio quality when packet losses occur.

It is an object of the present invention to provide such an audio error concealment system and method which can detect audio transmission errors, and effectively conceal missing or corrupted audio data segments without perceptible distortion to a listener.

It is a further object of the present invention to provide such a method and system audio reception in which the error concealment process uses control input from an enhanced frame error detection and a compressed domain beat detection.

It is a further object of the present invention to provide such a system and method which can recover short, transient signals when lost or distorted.

It is a further object of the present invention to provide a method and device suitable for audio reception in which the process of error concealment utilizes audio frame error detection and replacement.

It is yet another object of the present invention to provide such a device and method in which audio error detection and error concealment resources are efficiently used.

It is another object of the present invention to provide such a device which includes a decoder having enhanced audio frame error detection capability.

It is also an object of the present invention to provide a communication network system incorporating such a device and method in which error concealment is effected by frame replacement of the distorted or corrupted audio data.

Other objects of the invention will be obvious, in part, and, in part, will become apparent when reading the detailed description to follow.

SUMMARY OF THE INVENTION

The present invention results from the observations that an audio stream may not be stationary, that a music stream typically exhibits beat characteristics which do remain fairly constant as the music stream continues, and that a segment of audio data lost from one defined interval can be replaced by a corresponding segment of audio data from a corresponding preceding interval. By exploiting the beat pattern of music signals, error concealment performance can be significantly improved, especially in the case of long burst packet loss. The disclosed method, which can be advantageously incorporated into various audio decoding systems, is applicable to digital audio streaming, broadcasting via wireless channels, and downloading audio files for real-time decoding and conversion to audio signals suitable for output to a loudspeaker of an audio device or a digital receiver.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
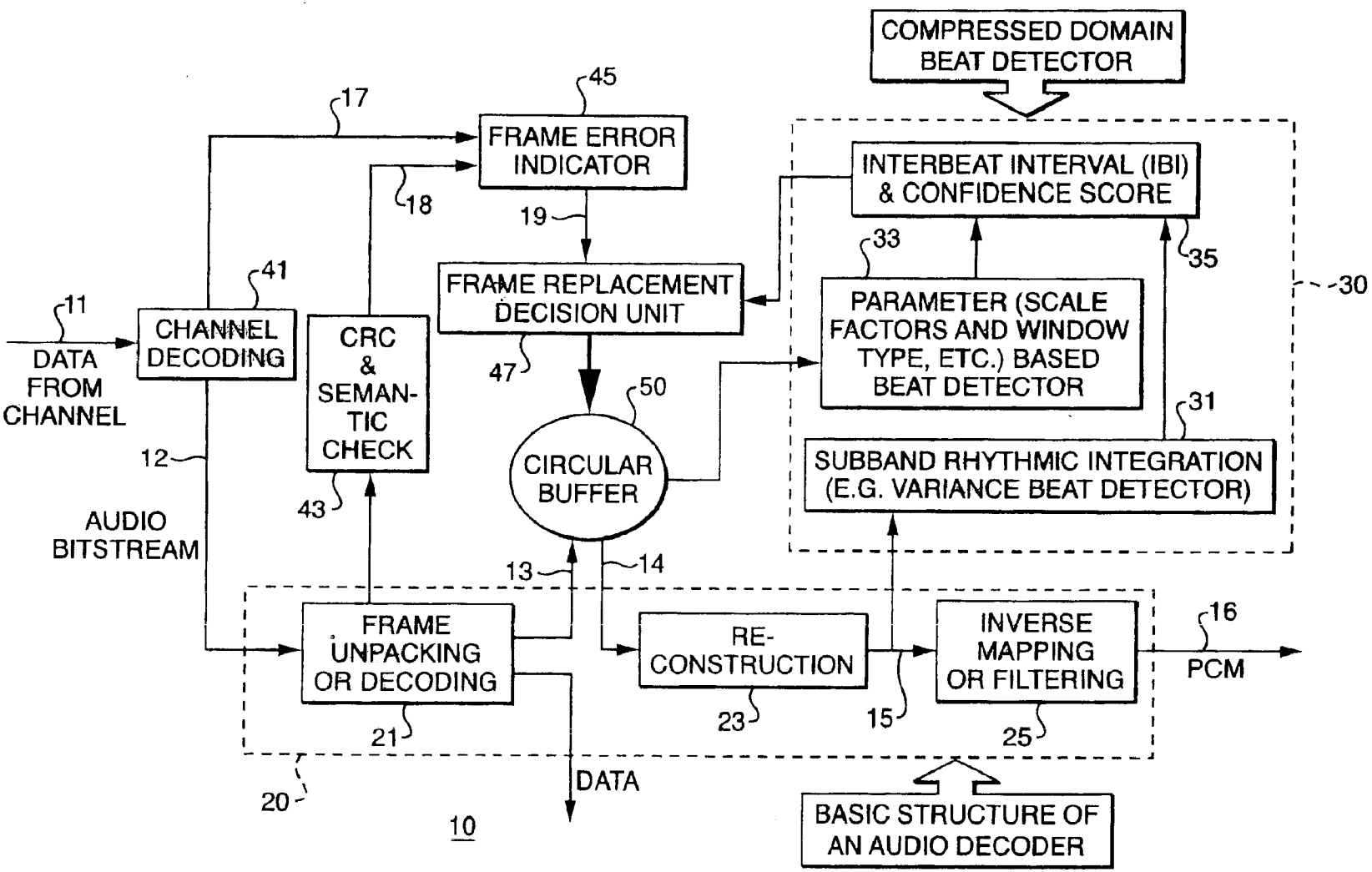
FIG. 1 is a basic block diagram of an audio decoder system including an audio decoder section, a beat detector, and a circular FIFO buffer in accordance with the present invention.

There is shown in FIG. 1 an audio decoder system 10 in accordance with the present invention. The audio decoder system 10 includes an audio decoder section 20 and a beat detector 30 operating on compressed audio signals. Audio data 11, such as may be encoded per ISO/IEC 11172-3 and 13818-3 Layer I, Layer II, or Layer III standards, are received at a channel decoder 41. The channel decoder 41 decodes the audio data 11 and outputs an audio bit stream 12 to the audio decoder section 20.

The audio bit stream 12 is input to a frame decoder 21 where frame decoding (i.e., frame unpacking) is performed to recover an audio information data signal 13. The audio information data signal 13 is sent to a circular FIFO buffer 50, and a buffer output data signal 14 is returned, as explained in greater detail below. The buffer output data signal 14 is provided to a reconstruction section 23 which outputs a reconstructed audio data signal 15 to an inverse mapping section 25. The inverse mapping section 25 converts the reconstructed audio data signal 15 into a pulse code modulation (PCM) output signal 16.

As noted above, the audio data 11 may have contained errors resulting from missing or corrupted data. When an audio data error is detected by the channel decoder 41, a data error signal 17 is sent to a frame error indicator 45. When a bitstream error found in the frame decoder 21 is detected by a CRC checker 43, a bitstream error signal 18 is sent to the frame error indicator 45. The audio decoder system 10 of the present invention functions to conceal these errors so as to mitigate possible degradation of audio quality in the PCM output signal 16.

Error information 19 is provided by the frame error indicator 45 to a frame replacement decision unit 47. The frame replacement decision unit 47 functions in conjunction with the beat detector 30 to replace corrupted or missing audio frames with one or more error-free audio frames provided to the reconstruction section 23 from the circular FIFO buffer 50. The beat detector 30 identifies and locates the presence of beats in the audio data using a variance beat detector section 31 and a window-type detector section 33, as described in greater detail below. The outputs from the variance beat detector section 31 and from the window-type detector section 33 are provided to an inter-beat interval detector 35 which outputs a signal to the frame replacement decision unit 47.

Figure 2:
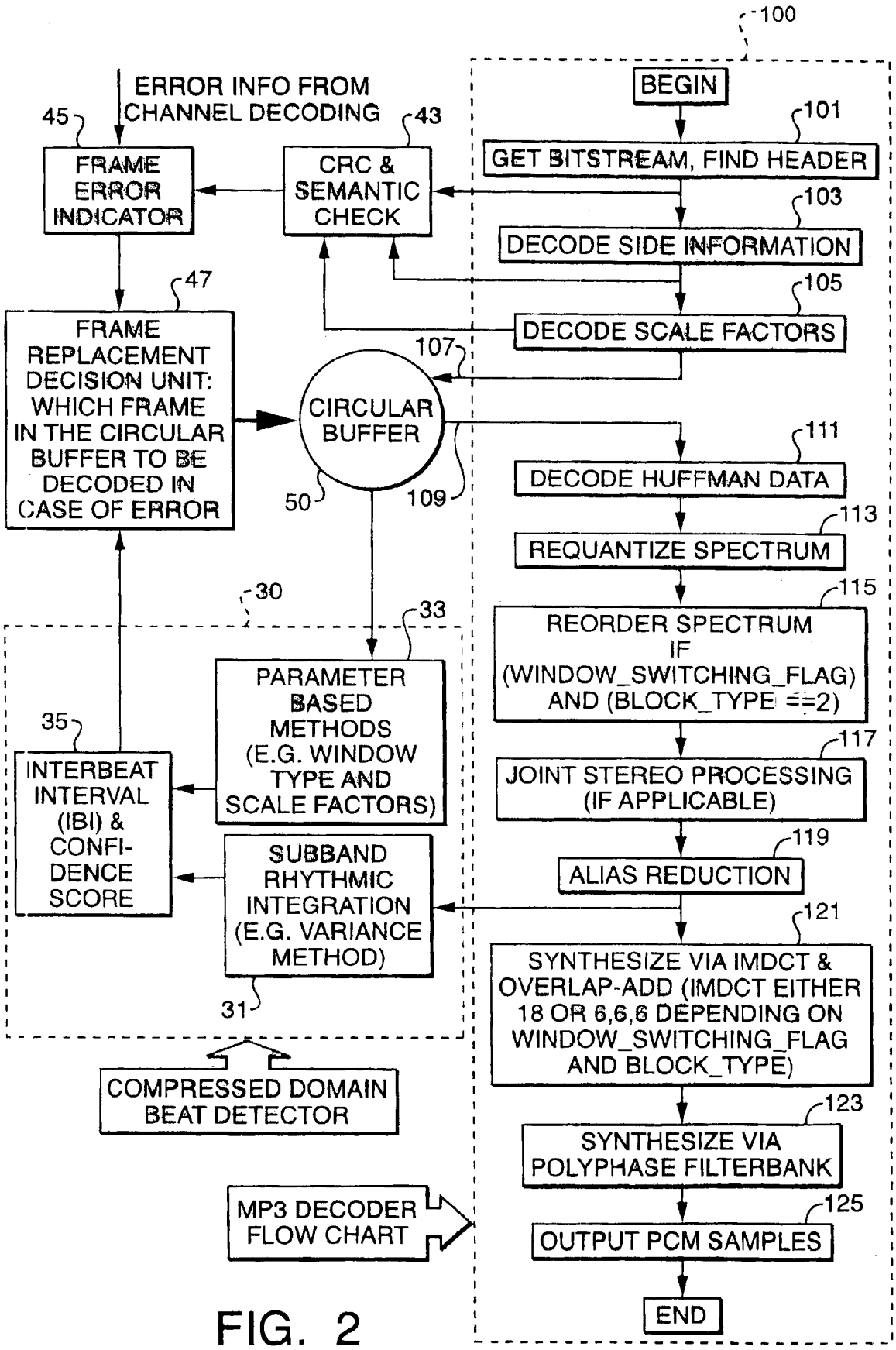
FIG. 2 is a flowchart of the operations performed by the decoder system of FIG. 1 when applied to an MP3 audio data stream.

This process of error concealment can be explained with reference to the flow diagram 100 of FIG. 2. For purpose of illustration, the operation of the audio decoder system 10 is described using MP3-encoded audio data but it should be understood that the invention is not limited to MP3 coding and can be applied to other audio transmission protocols as well. In the flow diagram 100, the frame decoder 21 receives the audio bit stream 12 and reads the header information (i.e., the first thirty two bits) of the current audio frame, at step 101. Information providing sampling frequency is used to select a scale factor band table. The side information is extracted from the audio bit stream 12, at step 103, and stored for use during the decoding of the associated audio frame. Table select information is obtained to select the appropriate Huffman decoder table. The scale factors are decoded, at step 105, and provided to the CRC checker 43 along with the header information read in step 101 and the side information extracted in step 103.

As the audio bitstream 12 is being unpacked, the audio information data signal 13 is provided to the circular FIFO buffer 50, at step 107, and the buffer output data 14 is returned to the reconstruction section 23, at step 109. As explained below, the buffer output data 14 includes the original, error-free audio frames unpacked by the frame decoder 21 and replacement frames for the frames which have been identified as missing or corrupted. The buffer output data 14 is subjected to Huffman decoding, at step 111, and the decoded data spectrum is requantized using a $4/3$ power law, at step 113, and reordered into sub-band order, at step 115. If applicable, joint stereo processing is performed, at step 117. Alias reduction is performed, at step 119, to preprocess the frequency lines before being inputted to a synthesis filter bank. Following alias reduction, the reconstructed audio data signal 15 is sent to the inverse mapping section 25 and also provided to the variance detector 31 in the beat detector 30.

In the inverse mapping section 25, the reconstructed audio data signal 15 is blockwise overlapped and transformed via an inverse modified discrete cosine transform (IMDCT), at step 121, and then processed by a polyphase filter bank, at step 123, as is well-known in the relevant art. The processed result is outputted from the audio decoder section 20 as the PCM output signal 16.

The CRC checker 43 performs error detection on the basis of checksums using a cyclic redundancy check (CRC) or a scale factor cyclic redundancy check (SCFCRC), are both specified in the ETS 300401. The CRC check is used for MP3 audio bitstreams, and the SCFCRC is used for Digital Audio Broadcasting (DAB) standard transmission.

The CRC error detection process is based both on the use of checksums and on the use of so-called fundamental sets of allowed values. When a non-allowed bit combination is detected, a transmission error is presumed in the corresponding audio frame. The CRC checker 43 outputs the bitstream error signal 18 to the frame error indicator 45 when a non-allowed frame is detected. The frame error indicator 45 obtains error indications both from the channel decoder 41 and from the CRC checker 43. Whenever an erroneous frame is identified to the frame error indicator 45, the frame replacement decision unit 47 receives an indication of the erroneous frame.

Figure 3:
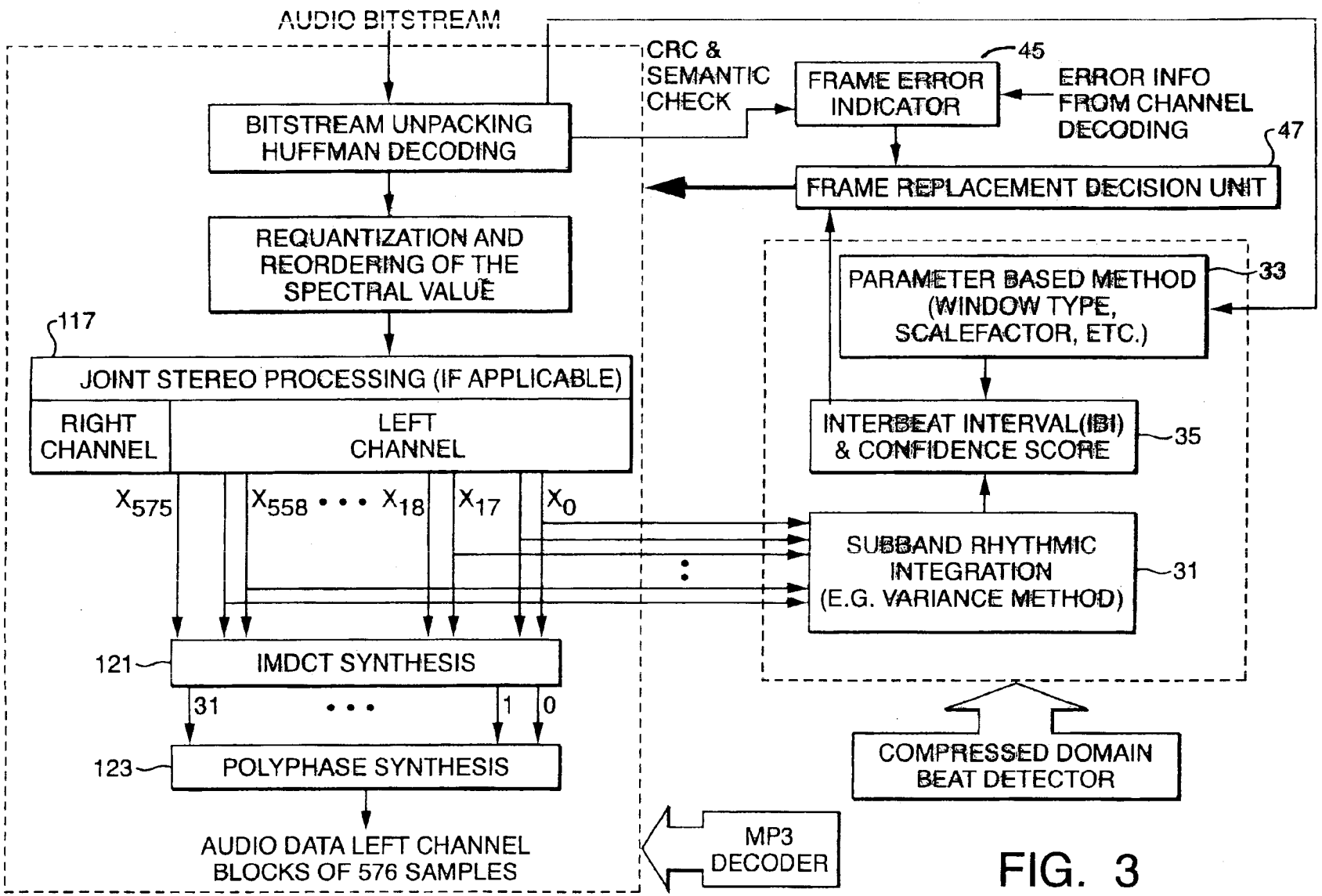
FIG. 3 is a diagram of an IMDCT synthesis operation for an MP3 audio data stream performed in the beat detector of FIG. 2.

Operation of the audio decoder system 10 can be further described with reference to the compressed domain beat detector 30 diagram of FIG. 3. In general, frequency resolution is provided by means of a hybrid filter bank. Each band is split into 18 frequency lines by use of a modified Discrete Cosine Function (MDCT). The window length of the MDCT is 18, and adaptive window switching is used to control time artifacts also known as 'pre-echoes.' The frequency with better time resolution and short blocks (i.e., as defined in the MP3 standard) are used can be selected. The signal parts below a frequency are coded with better frequency resolution. Parts of the signal above are coded with better time resolution. The frequency components are quantized using the non-uniform quantizer and Huffman encoded. A buffer is used to help enhance the coding efficiency of the Huffman coder and to help in the case of pre-echo conditions. The size of the input buffer is the size of one frame at the bit rate of 160 Kb/sec per channel for Layer III.

The short term buffer technique used is called 'bit reservoir' because it uses short-term variable bit rate with maximal integral offset from the mean bit rate. Each frame holds the data from two granules. The audio data in a frame is allocated including a main data pointer, side information of both granules, scale factor selection information (SCFSI), and side information of granule 1 and granule 2. The header and audio data constitute the side information stream including the scale factors and Huffman code data granule 1, scale factors, and Huffman code data granule 2, and ancillary data. These data constitute the main data stream. The main data begin pointer specifies a negative offset from the position of the first byte of the header.

The audio frame begins with the main data part, which is located by using a 'main data begin' pointer of the current frame. All main data is resident in the input buffer when the header of the next frame is arriving in the input buffer. The audio decoder section 20 has to skip header and side information when doing the decoding of the main data. As noted above, the table select information is used to select the Huffman decoder table and the number of 'lin' bits (also known as ESC bits), where the scale factors are decoded, in step 105. The decoded values can be used as entries into a table or used to calculate the factors for each scale factor band directly. When decoding the second granule, the SCFSI has to be considered. In step 103, all necessary information, including the table which realizes the Huffman code tree, can be generated. Decoding is performed until all Huffman code bits have been decoded or until quantized values representing 576 frequency lines have been decoded, whichever comes first.

In step 115, the requantizer uses a power law. For each output value 'is' from the Huffman decoder, $(is)^{4/3}$ is calculated. The calculation can be performed either by using a lookup table or doing explicit calculation. One complete formula describes all the processing from the Huffman decoding values to the input of the synthesis filter bank.

In addition to detecting errors based on the CRC or the SCFCRC, ISO/IEC 11172-3 defines a protection bit which indicates that the audio frame protocol structure includes valid checksum information of 16-bit CRC. It covers third and fourth bytes in the frame header and bit allocation section and the SCFSI part of the audio frame. According to the DAB standard ETS 300401, the audio frame has additionally a second checksum field, which covers the most significant bits of the scale factors.

The 16-bit CRC polynomial generating checksum is $G_1(X)=X^{16}+X^{15}+X^2+1$. If the polynomial calculated for the bits of the third and fourth bytes in the frame header and an allocation part does not equal the checksum in the received frame, a transmission error is detected in a frame. The polynomial generating all CRC checksums protecting the scale factors is $G_2(X)=X^8+X^4+X^3+X^2+1$.

In step 117, the reconstructed values are processed for MS of intensity stereo modes or both, before the synthesis filter bank stage. In step 123 starts the synthesis filter band functionality section. In step 121, the IMDCT is used as synthesis applied that is dependent on the window switching and the block type. If n is the number of the windowed samples (for short blocks, n=12, for long blocks, n=36). The n/2 values $X_k$ are transformed to n values x. The formula for IMDCT is the following:

$$X_i = \sum_{k=0}^{\frac{n}{2}-1} X_k \cos\left(\frac{\pi}{2n}\left(2i+1+\frac{n}{2}\right)(2k+1)\right) \quad (1$$

for $0 \leqq i \leqq (n-1)$.

Different shapes of windows are used. Overlapping and adding with IMDCT blocks is done in step 121 so that the first half of the block of thirty six values is overlapped with a second half of the previous block. The second half of the actual block is stored to be used in the next block. The final audio data synthesizing is then done in step 123 in the polyphase filter bank, which has the input of sub bands labeled 0 through 31, where the 0 band is the lowest sub band.

In the step 121, IMDCT synthesis is done separately for the right and the left channels. The variance analysis is done at this state and the variance result is fed into the beat detector 30 in which the beat detection is made. If an erroneous frame is detected in the frame error indicator 45, a replacement frame is selected from the circular FIFO buffer 50, which is controlled by the frame replacement decision unit 47. The alias reduction of the IMDCT is used as synthesis applied, that is dependent on the window switching and the block type.

Figure 4:
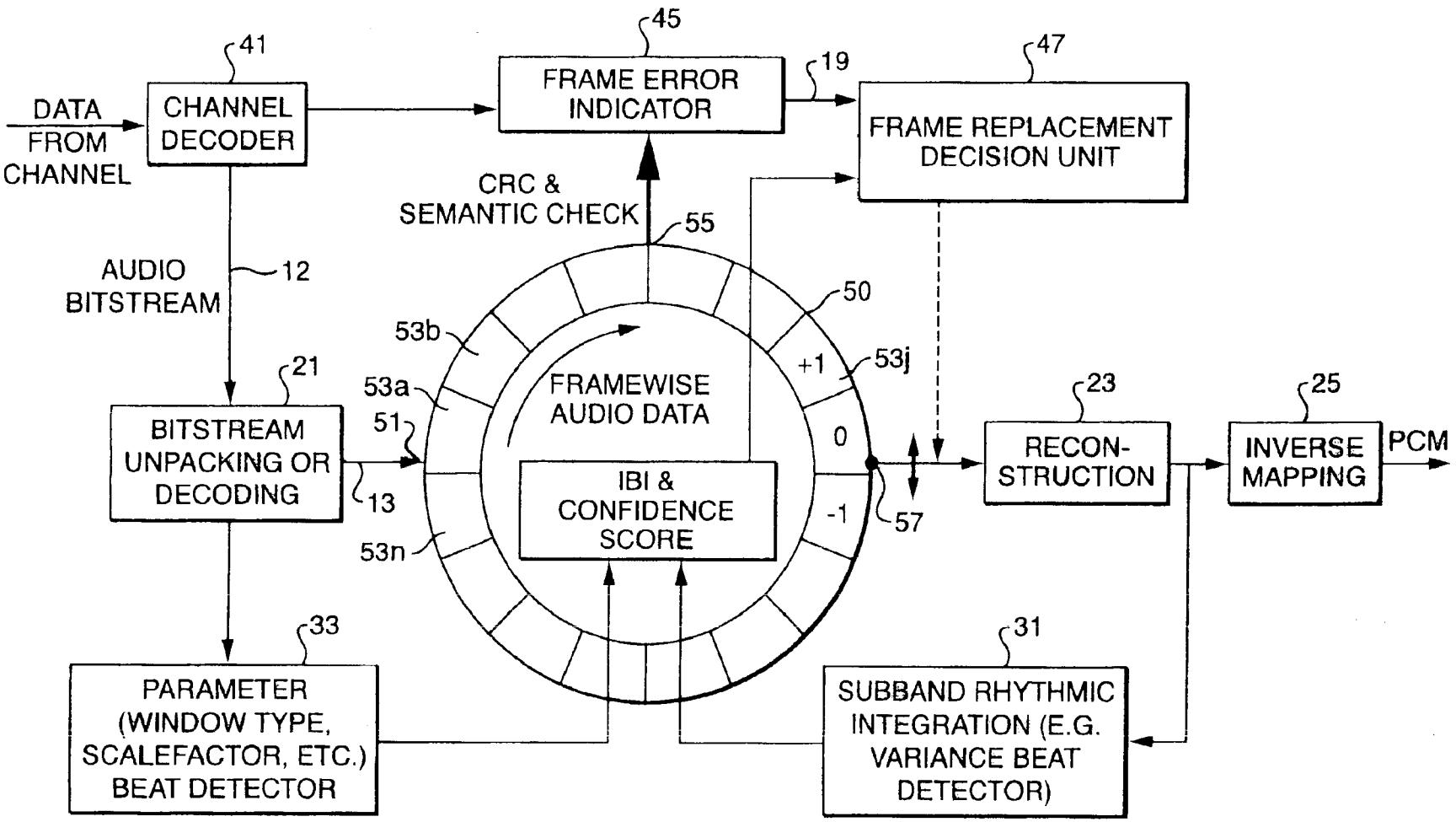
FIG. 4 is a diagrammatical representation of the beat detector of FIG. 1.

FIG. 4 shows the audio decoder system 10 with a more detailed diagrammatical view of the circular FIFO buffer 50. The incoming digital audio bit stream 12 is provided to an input port 51 of the circular FIFO buffer 50. The FIFO buffer 50 includes a plurality of single-frame audio data blocks 53*a*, 53*b*, . . . 53*j* . . . , 53*n*. Each of the audio data blocks 53*a*, 53*b*, . . . 53*j* . . . , 53*n* holds one corresponding audio data frame from the audio information data signal 13. In an MP3 application, for example, the audio data frame size is approximately thirteen msec in duration for a sampling rate of 44.1 KHz. The circular FIFO buffer 50 holds the most recent audio data frame in the audio data block 53*a*, the next most recent audio data frame has been stored in the audio data block 53*b*, and so on to the audio data block 53*n*.

Operation of the circular FIFO buffer 50 provides for the next audio data frame (not shown) received via the audio information data signal 13 to be placed into the audio data block 53*a*. The audio data frame of speech in a GSM system is typically 20 msec in duration. Accordingly, the previously most recent audio data frame is moved from the audio data block 53*a* to the audio data block 53*b*, the audio data frame in the audio data block 53*b* is moved to the audio data block 53*c*, and so on. The audio data frame originally stored in the audio data block 53*n* is removed from the circular FIFO buffer 50.

The side information of the audio data frames incoming to the input port 51 are also provided to the beat detector 30 which is used to locate the position of beats in the audio information data signal 13, as explained in greater detail below. A detector port 55 is connected to the frame error indicator 45 in order to provide control input which indicates which audio frame in the circular FIFO buffer 50 is to be decoded next. The replacement frame is searched according to the most suitable frame search method of the frame replacement decision unit 47, and the replacement frame is read and forwarded from the circular FIFO buffer 50 resulting in a more appropriate frame to the inverse filtering. An output port 57 is connected to the reconstruction section 23.

It generally requires about sixteen Kbytes of capacity in the circular FIFO buffer 50 to store inter-beat intervals of a monophonic signal. The audio frame data is fed from the frame decoder 21 to the block 53*a*, after which the error detection is made for the unpacked audio frame. If the frame error indicator 45 doesn't indicate an erroneous frame, the beat detector 30 enables the audio frame data to be stored to the circular FIFO buffer 50 as a correct audio frame sample.

The beat detector 30 includes a beat pointer (not shown) which serves to identify an audio data frame at which the presence of a beat has been detected, as described in greater detail below. In a preferred embodiment, the time resolution of the beat detector 30 is approximately thirteen msec. The beat pointer moves sequentially along the audio data blocks 53*a*, 53*b*, . . . , 53*n* in the circular FIFO 50 until a beat is detected. The replacement port 57 outputs the audio data frame containing the detected beat by locating the block position identified by the beat pointer.

Figure 5:
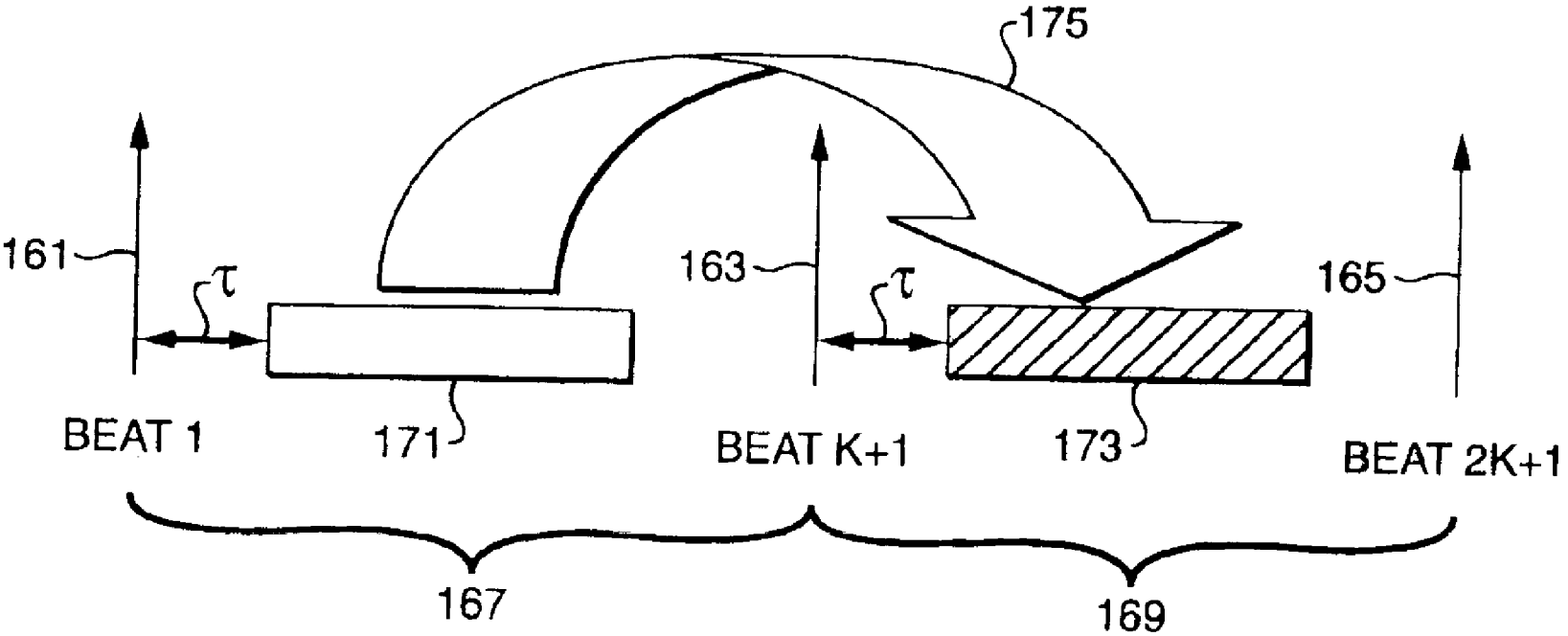
FIG. 5 illustrates the replacement of an erroneous audio segment in an inter-beat interval using the system of FIG. 1.

FIG. 5 provides a diagrammatical representation of a first beat 161, a $(k+1)^{th}$ beat 163 and a $(2k+1)^{th}$ beat 165 of the audio information data signal 13. The first beat 161 occurs earlier in time than the $(k+1)^{th}$ beat 163, and the $(k+1)^{th}$ beat 163 occurs before the $(2k+1)^{th}$ beat 165.

In a preferred embodiment, the size of the circular FIFO buffer 50 is specified to be large enough so as to hold the audio data frames making up both a first inter-beat interval 167 and a second inter-beat interval 169. In way of example, the bit rate of a monophonic signal is 64 Kbps with an inter-beat interval of approximately 500 msec. It thus requires about sixteen Kbytes of capacity in the circular FIFO buffer 50 to store two inter-beat intervals of audio data frames for a monophonic signal. In the illustration provided, the audio data frames making up the first inter-beat interval 167 have been found error-free.

On the other hand, if errors are detected by the frame error indicator 45, the corresponding erroneous audio data frames are not transmitted to the reconstruction section 23. For example, the frame error indicator 45 will indicate an erroneous audio segment 173 in the audio data frames making up the second inter-beat interval 169. The time interval from the $(k+1)^{th}$ beat 163 to the beginning of the erroneous audio segment 173 is here denoted by the Greek letter '$\tau$.' In accordance with the disclosed invention, the audio decoder system 10 operates to conceal the transmission errors resulting in the erroneous audio segment 173 by replacing the erroneous audio segment 173 with a corresponding replacement audio segment 171 from the first beat interval 167, as indicated by arrow 175.

This error concealment operation begins when the frame error indicator 45 indicates the first audio data frame containing errors in the second inter-beat interval 169. The frame error indicator 45 sends the error detection signal 19 to the frame replacement decision unit 47 which acts to preclude the erroneous audio segment 173 from passing to the reconstruction section 23. Instead, the replacement audio segment 171 passes via the replacement port 57 of the circular FIFO buffer 50 to the reconstruction section 23. After the replacement audio segment 171 has passed to the reconstruction section 23, subsequent error-free data packets are passed to the reconstruction section 23 without replacement.

The replacement audio segment 171 is specified as a contiguous aggregate of replacement audio data frames having essentially the same duration as the erroneous audio segment 173 and occurring a time $\tau$ after the first beat 161. That is, each erroneous audio data frame in the erroneous audio segment 173 is replaced on a one-to-one basis by a corresponding replacement audio data frame taken from the replacement audio segment 171 stored in the circular FIFO buffer 50. It should be noted that the time interval $\tau$ can have a positive value as shown, a negative value, or a value of zero. Moreover, when $\tau$ has a zero value, the duration of the replacement audio segment 171 can be the same as the duration of the entire first inter-beat interval 167.

Figure 6A:
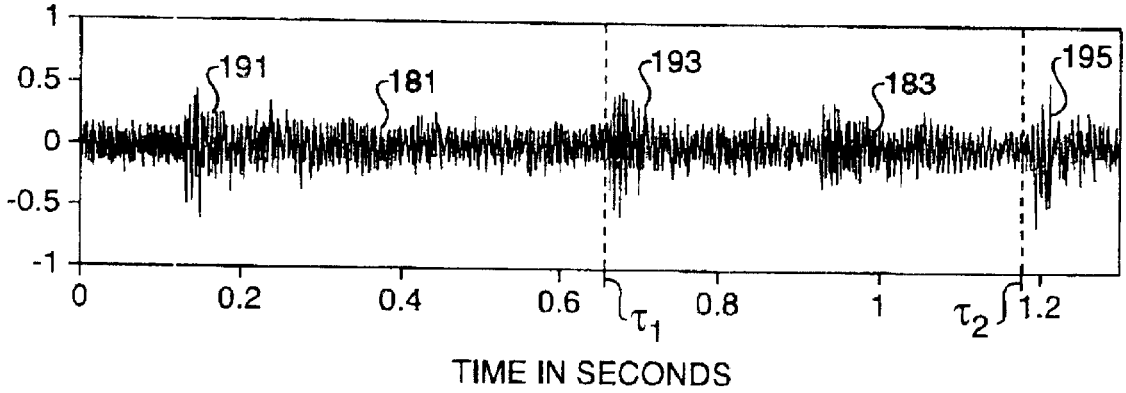
FIGS. 6A through 6D illustrate various methods of error concealment.
Figure 6B:
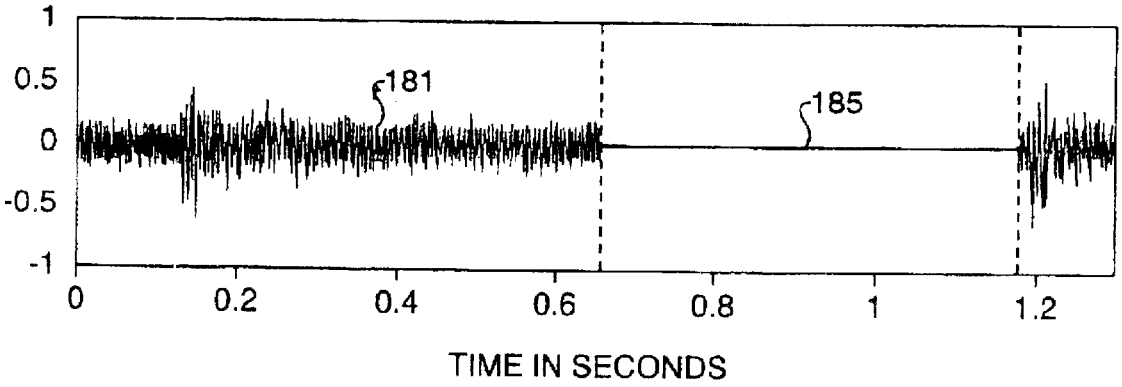

This can be explained with reference to FIGS. 6A through 6D which present a comparison of the disclosed method with other, conventional methods. A normal, error-free audio transmission is represented in the graph of FIG. 6A by a first beat-to-beat interval waveform 181 and a second beat-to-beat waveform 183. The first waveform 181 includes a first beat 191 and the audio information up to a second beat 193. Similarly, the second waveform 183 includes the second beat 193 and the audio information up to a third beat 195.

Consider an audio data loss of the second waveform 183, occurring between time $\tau_1$ and time $\tau_2$, an interval approximately 520 msec in duration (i.e., approximately forty MP3 audio data frames). Because most conventional error-concealment methods are not intended to deal with errors greater than an audio frame length used in the applied transfer protocol in duration, the conventional error concealment method will not produce satisfactory results. One conventional approach, for example, is to substitute a muted waveform 185 (FIG. 6B) for the second waveform 183, as shown in the next graph. Unfortunately, this waveform will be objectionable to a listener as there is an abrupt transition from the first waveform 181 to the muted waveform 185, and the second beat 193 is missing.

Figure 6C:
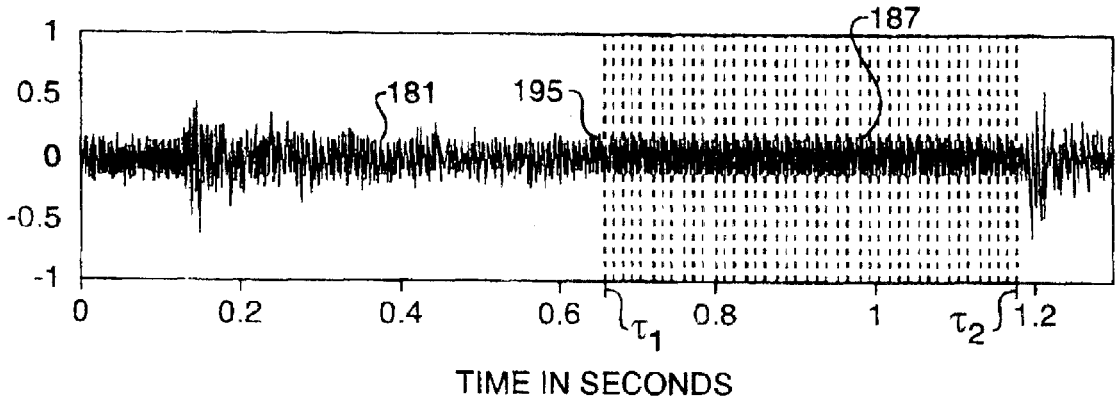

In another conventional approach, shown in the graph of FIG. 6C, an audio data frame 195 occurring just before time $\tau_1$ is repeatedly copied and added to fill the interval $\tau_1$ to $\tau_2$, resulting in a monotonic waveform 187. This configuration will also be objectionable to a listener as there is little if any musical content in the monotonic waveform 187, and the second beat 193 is also missing.

Figure 6D:
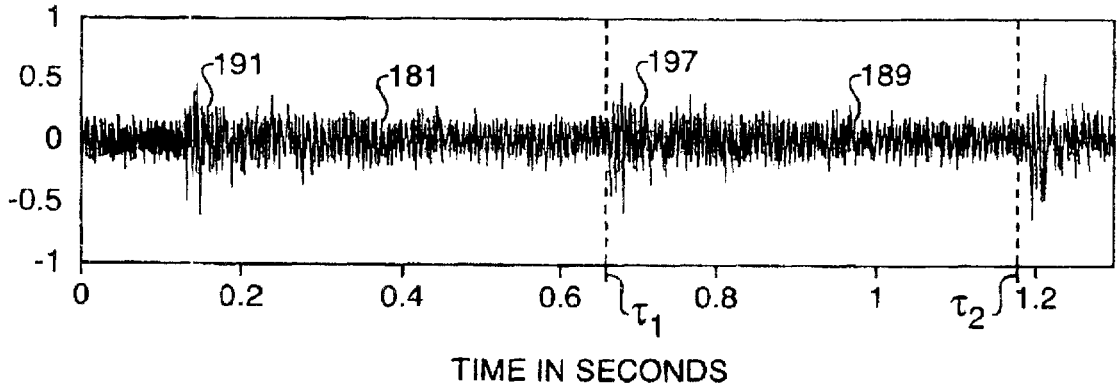

In accordance with the method of the present invention, a replacement waveform 189 including a replacement beat 197, is copied from the first beat 191 and the first waveform 181, and is substituted for the missing audio segment 185 in the time interval $\tau_1$ to $\tau_2$, as shown in the graph of FIG. 6D. As can be appreciated by one skilled in the relevant art, the music portion represented by the waveform 189 with the replacement beat 197 is more closely representative of the original waveform 183 and second beat 193 than is the error-concealment waveform 187.

Figure 7:
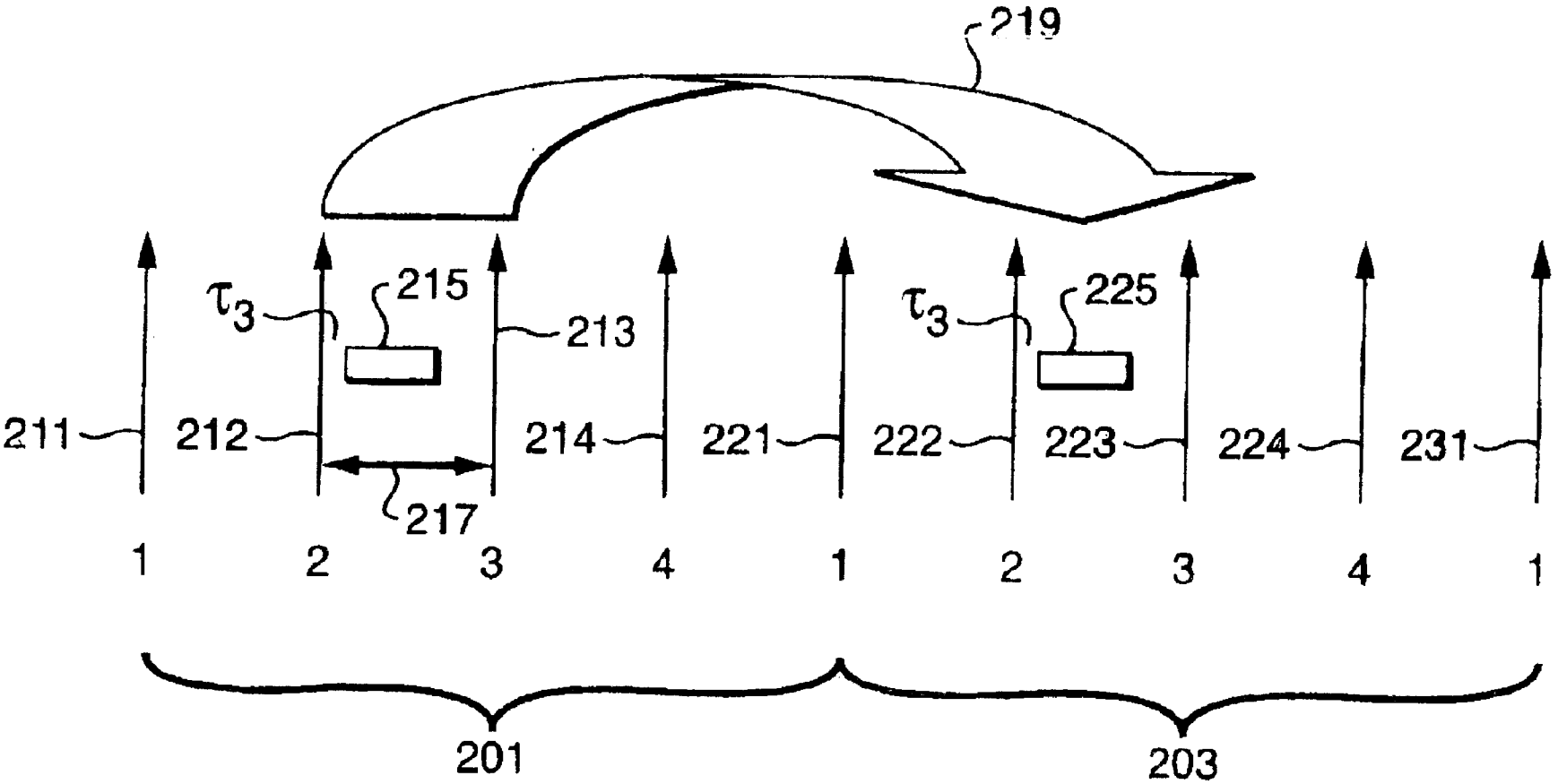
FIG. 7 illustrates the replacement of an erroneous audio segment in a bar of music using the system of FIG. 1.

In a preferred embodiment, shown in FIG. 7, the audio information in an erroneous beat-to-beat interval is replaced by the audio data frames from a corresponding beat-to-beat interval in a preceding 4/4 bar. Most popular music has a rhythm period in 4/4 time.

A first bar 201 includes the musical information present from a first beat 211 in the first bar 201 to a first beat 221 in a second bar 203. The first bar 201 includes a second beat 212, a third beat 213, and a fourth beat 214. Similarly, the second bar includes a second beat 222, a third beat 223, and a fourth beat 224. As received by the audio decoder system 10, the second bar 203 includes an erroneous audio segment 225 occurring between the second and third beats 222 and 223 and at a time interval $\tau_3$ following the second beat 222.

A replacement segment 215, having the same duration as the erroneous audio segment 225, is copied from the audio data frames in the interval 217 between the second and third beats 212 and 213, where the replacement segment 215 is located a time interval $\tau_3$ from the second beat 212. The replacement segment 215 is substituted for the erroneous audio segment 225 as indicated by arrow 219. If this replacement occurs in the PCM domain, a cross-fade should be performed to reduce the discontinuities at the boundaries If the audio bit stream is an MP3 audio stream, a cross-fade is usually not necessary because of the overlap and add process performed in step 121, as described above.

Beat Detection

Beat is defined in the relevant art as a series of perceived pulses dividing a musical signal into intervals of approximately the same duration. In the present invention, beat detection can be accomplished by any of three methods. The preferred method uses the variance of the music signal, which variance is derived from decoded Inverse Modified Discrete Cosine Transformation (IMDCT) coefficients as described in greater detail below. The variance method detects primarily strong beats. The second method uses an Envelope scheme to detect both strong beats and offbeats. The third method uses a window-switching pattern to identify the beats present. The window-switching method detects both strong and weaker beats. In one embodiment, a beat pattern is detected by the variance and the window switching methods. The two results are compared to more conclusively identify the strong beats and the offbeats.

In accordance with the variance method, the variance (VAR) of the music signal at time $\tau$ is calculated directly by summing the squares of the decoded IMDCT coefficients to give:

$$\mathrm{VAR}(\tau) = \sum_{j=0}^{575} [X_j(\tau)]^2 \quad (2$$

where $X_j(\tau)$ is the $j^{th}$ IMDCT coefficient decoded at time $\tau$. The location of the beats are determined to be those places where VAR($\tau$) exceeds a pre-determined threshold value.

In the alternative Envelope method, an envelope measure (ENV) is used, where $$ENV(\tau) = \sum_{j=0}^{575} \mathrm{abs}[X_j(\tau)] \quad (3$$

where abs($X_j$) are the absolute values of the IMDCT coefficients. Equations (2) and (3) are included in the variance beat detector section 31. With a threshold method similar to VAR($\tau$), ENV($\tau$) is used to identify both strong and offbeats, while VAR($\tau$) is used to identify primarily strong beats.

Figure 8:
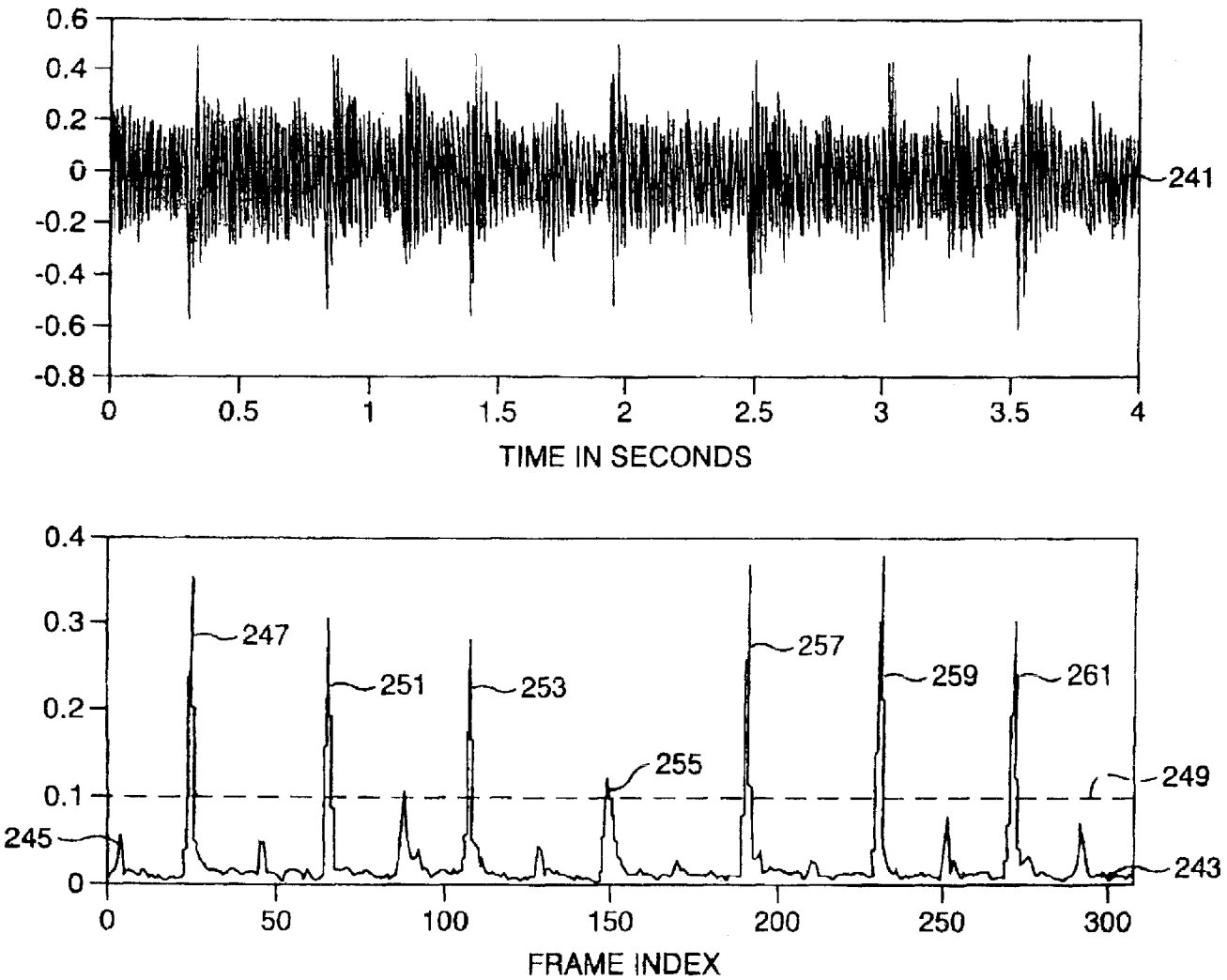
FIG. 8 shows a musical signal and the associated variance curve.

FIG. 8 illustrates the variance method. A four-second musical sample is represented by a graph 241. The variance of the graph 241 is determined by calculating equation (2) for each of the approximately three hundred audio data frames in the graph 241. The results are represented by a variance graph having low peaks, such as a low peak 245, and high peaks, such as a high peak 247. A threshold 249, which value may be derived empirically, is specified such that the low peak 245 is not identified with the presence of a beat, but that the high peak 247 represents the location of a beat. With the value of the threshold 249 selected as shown, a series of seven beats is identified at peak locations 247 to 261. Although the threshold 249 may be derived empirically, in a preferred embodiment, the threshold is derived from the statistical characteristics of the music signal.

Figure 9:
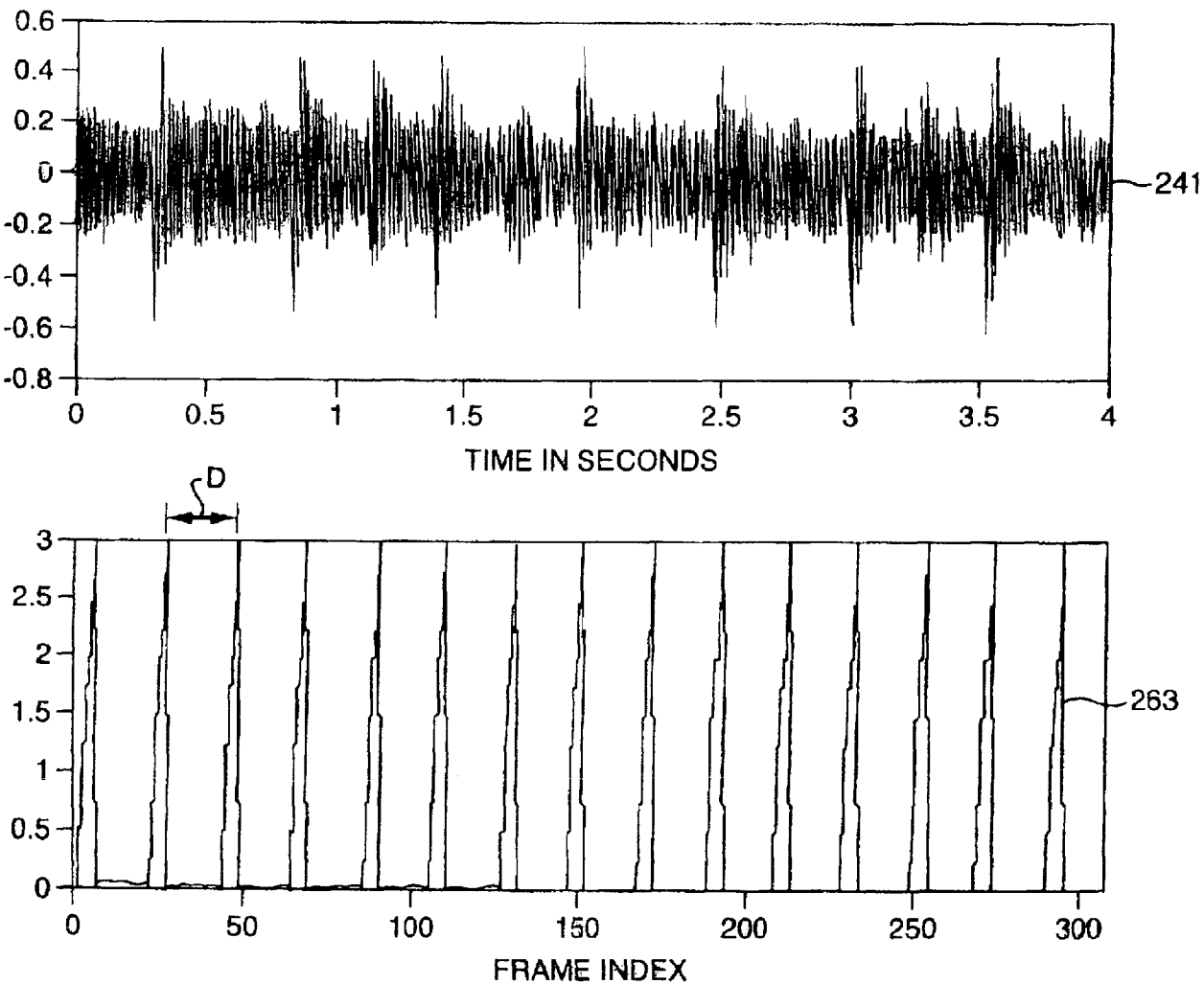
FIG. 9 shows a musical signal and the associated window-switching pattern.

In FIG. 9, the window switch happens both in strong beats and in offbeats (i.e., weak beats). Consequently, reliance is placed on the variance method in most applications. The window switch can still be used to determine an inter-beat interval in the graph 241, even though it is not known which detected beat is the strong beat and which detected beat is the offbeat. The distance 'D' between two window switches 263 is 265 msec. Thus, 2D is 530 msec, and 3D is 795 msec.

Figure 10:
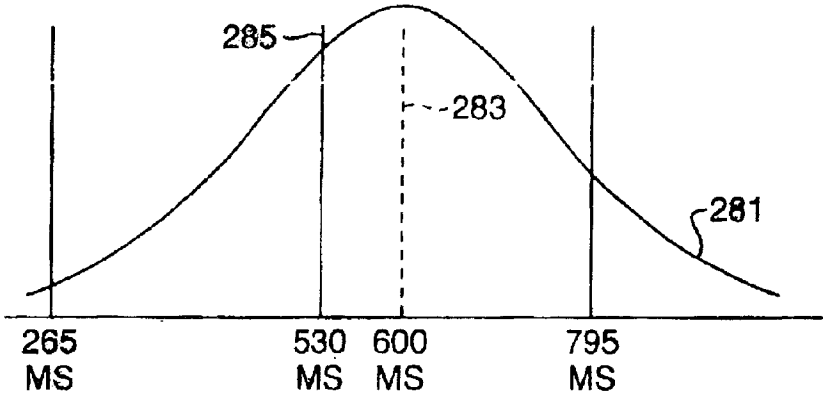
FIG. 10 is a distribution curve of musical inter-beat intervals.

As shown in FIG. 10, which represents inter-beat interval detection based on musical knowledge, the most probable inter-beat interval is approximately 600 msec. Thus, the probability of a music inter-beat interval is a Gaussian distribution 281 with a mean 283 of 600 msec. Applying the probability function to the three values of D, 2D, and 3D obtained from the graph 241 in FIG. 9, we can easily have the 530 msec value 285 (i.e., 2D) as the correct inter-beat interval from the maximum likelihood method.

A 'confidence score' parameter on beat detection is introduced to the audio decoder system 10, as exemplified in the embodiments (e.g., FIGS. 1–4) of the present invention, to prevent erroneous beat replacement. The confidence score is defined as the percentage of the correct beat detection within the observation window. The confidence score is used to measure how reliably beats can be detected within the observation window (typically one to two bars in duration in the circular FIFO buffer 50). To illustrate, if all the beats in the window can be correctly detected, the confidence score is one. If no beat in the window can be detected, the confidence score is zero. Accordingly, a threshold value is specified. Thus, if the confidence score is above the threshold value, the beat replacement is enabled. Otherwise, the beat replacement is disabled.

Figure 11:
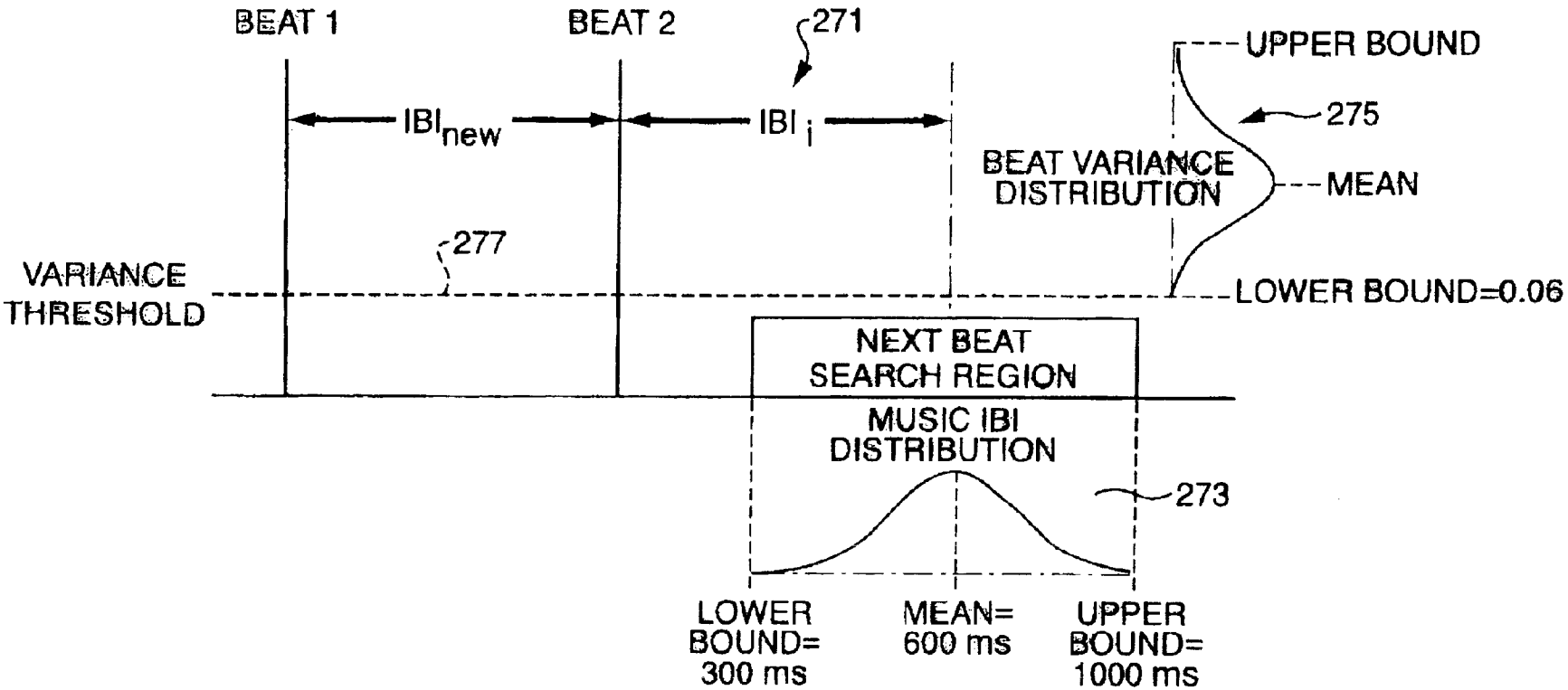
FIG. 11 illustrates a method of inter-beat interval estimation.

One recursive method for estimating the inter-beat interval can be described with reference to FIG. 11 which uses the recursive formula, $$IBI_i = IBI_{i-1} \cdot (1-\alpha) + IBI_{new} \cdot \alpha \quad (4$$

to estimate an inter-beat interval 271 recursively. In equation (4), $IBI_i$ is the current estimation of the inter-beat interval, $IBI_{(i-1)}$ is the previous estimation of the inter-beat interval, $IBI_{new}$ is the most recently-detected inter-beat interval, and $\alpha$ is a weighting parameter to adjust the influence of the history and new data.

A second recursive method operates by estimating the current inter-beat interval $IBI_i$ by averaging a few of the previous inter-beat intervals using the expression, $$IBI_i = \frac{1}{N} \sum_{j=i-1}^{(i-1)-(N-1)} IBI_j \quad (5$$

Alternatively, the inter-beat interval 271 can be estimated by using equation (5) only.

If we assume that both the music inter-beat interval distribution 273 and the beat variance distribution 275 are Gaussian distributions, the respective mean and variance can be estimated recursively in a manner similar to that used with equation (4). As stated above, the variance threshold 277 can be established empirically. In the example provided, a lower bound of 0.06 has been set for the variance threshold 277. The actual value may vary according to the particular application. In FIG. 8, for example, the threshold 249 has been set at 0.1. Accordingly, a beat has been identified at a peak location 255. This beat would have been missed if the value for the threshold 249 had been greater than 0.1.

When errors occur in audio transmittal applications using the Global System for Mobile Communications (GSM) protocol, the errors normally occur at random. Occasional losses of single or double packets are more likely to occur in Internet applications, where each packet has a duration of about 20 msec, to give a packet-loss error of about 40 msec in duration. Using this model, the capacity requirement of the circular FIFO buffer 50 can be reduced. When the reduced memory capacity is used, fewer audio data frames need to be stored in the circular FIFO buffer 50.

Figure 12:
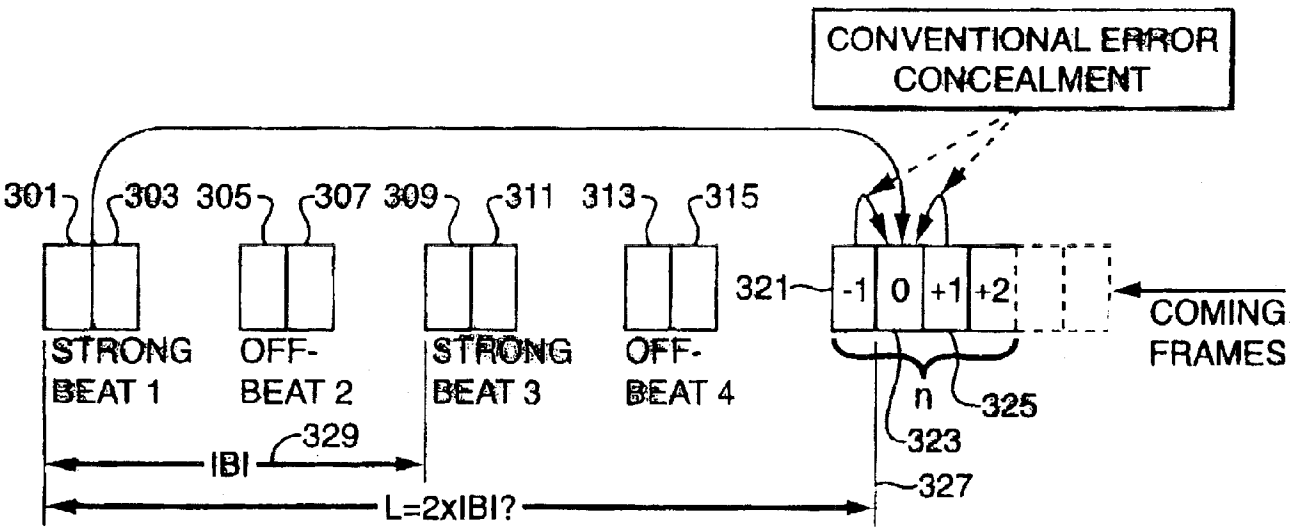
FIG. 12 shows the storage of a reduced quantity of audio data frames in the buffer of FIG. 1.

In an alternative embodiment, the memory storage capacity of the circular FIFO buffer 50 can be reduced by storing only selected audio frames rather than every audio frame in the incoming stream. In a first example, shown in FIG. 12, two audio frames 301 and 303 at strong beat 1 are stored in the circular FIFO 50. Additionally, two audio frames 305 and 307 at offbeat 2 are stored, two audio frames 309 and 311 at strong beat 3 are stored, and two audio frames 313 and 315 at offbeat 4 are stored in the circular FIFO 50. Note that none of the audio frames occurring between audio frames 303 and 305, between audio frames 307 and 309, and between audio frames 311 and 313 are stored. Accordingly, when a defective audio frame 323 (frame 0) is identified, the defective frame 323 can be replaced by audio frame 301 since the defective audio frame 323 occurs at a beat 327. In a conventional error concealment method, the defective audio frame 323 could be replaced by either a previous audio frame 321 (frame−1) or by a subsequent audio frame 325 (frame+1).

The group of audio framed denoted by 'n' includes four audio frames of which the audio frame 323 (frame 0), indicates the audio frame currently being sent to the listener via a loudspeaker, for example. The previously-received audio frame is audio frame 321 (frame−1), and the next frame after the audio frame 323 is the audio frame 325 (frame+1). The audio frame 325 is the next available audio frame to be decoded.

Figure 13:
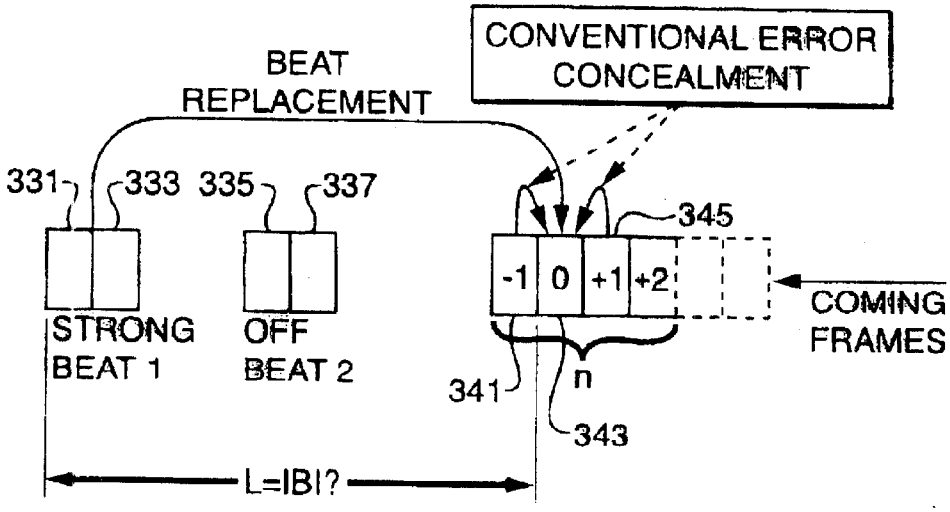
FIG. 13 shows another embodiment of the storage method of FIG. 12.
Figure 14:
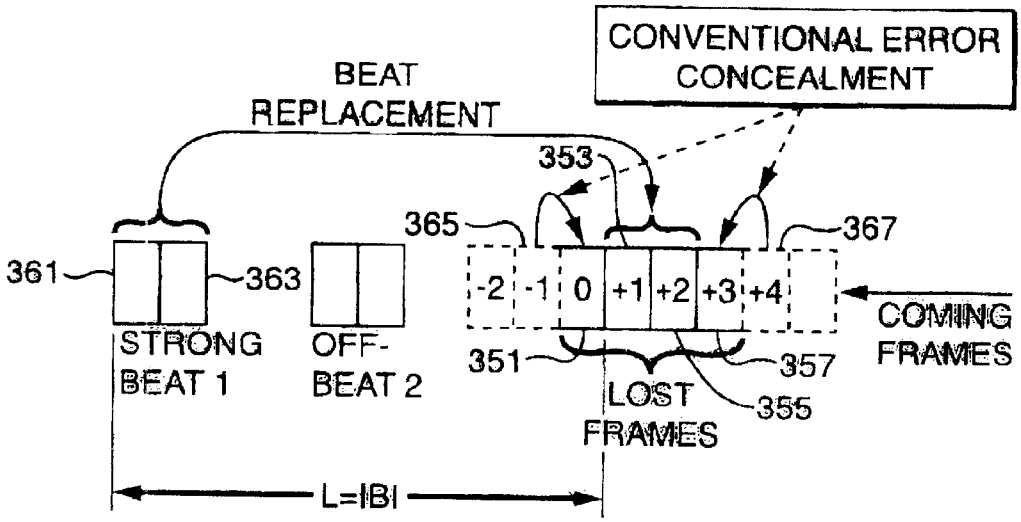
FIG. 14 shows yet another embodiment of the storage method of FIG. 12.

In another embodiment, shown in FIG. 13, only two audio frames 331 and 333 at strong beat 1 and two audio frames 335 and 337 at offbeat 2 have been stored, so as to place a smaller demand on the memory storage capacity of the circular FIFO 50. The next-arriving audio frame 345 (frame+1) is interpolated with the previous audio frame 341 to produce replacement data for a corrupted audio frame 343 (frame 0). In the embodiment of FIG. 14, four audio frames 351 (frame 0), 353 (frame+1), 355 (frame+2), and 357 (frame+3) have been lost. Since this loss occurred at a beat location, the audio frames are replaced by previously-stored audio frames 361 and 363 occurring at strong beat 1. The audio frame 351 can be replaced by a previous audio frame 365 (frame−1), and the audio frame 357 can be replaced by the next audio frame 367 (frame+4) in the audio stream.

Figure 15:
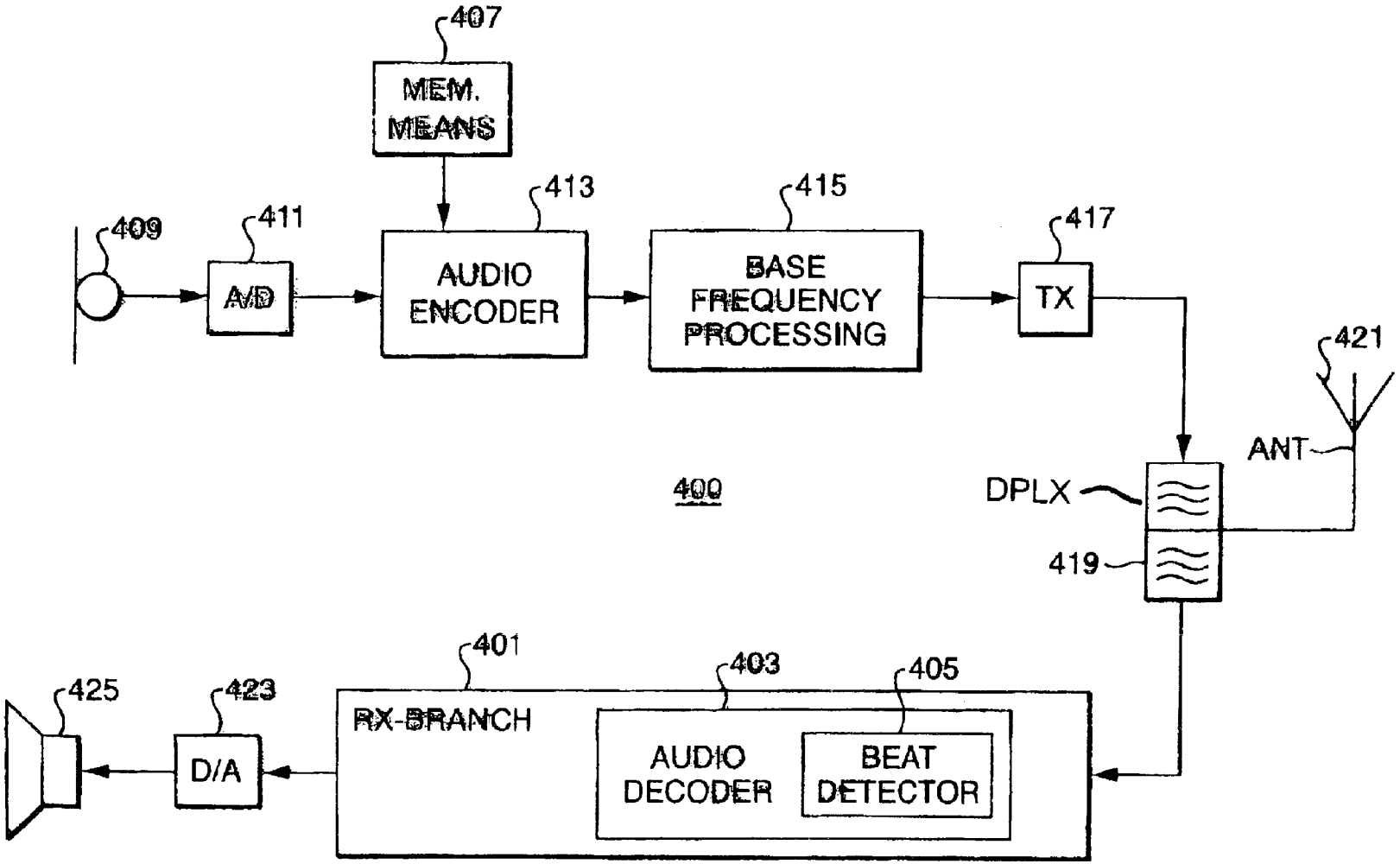
FIG. 15 shows a transmitter and receiver apparatus, including the audio decoder system of FIG. 1, in which the receiver receives real-time audio from a network.

FIG. 15 presents as a block diagram the structure of a mobile phone 400, also known as a mobile station, according to the invention, in which a receiver section 401 includes a beat detector control block 405 included in an audio decoder 403. A received audio signal is obtained from a memory 407 where the audio signal has been stored digitally. Alternatively, audio data may be obtained from a microphone 409 and sampled via an A/D converter 411. The audio data is encoded in an audio encoder 413 after which the processing of the base frequency signal is performed in block 415. The channel coded signal is converted to radio frequency and transmitted from a transmitter 417 through a duplex filter 419 (DPLX) and an antenna 421 (ANT). At the receiver section 401, the audio data is subjected to the decoding functions including beat detection, according to any of the teachings of the alternative embodiments explained above. The recorded audio data is directed through a D/A converter 423 to a loudspeaker 425 for reproduction.

Figure 16:
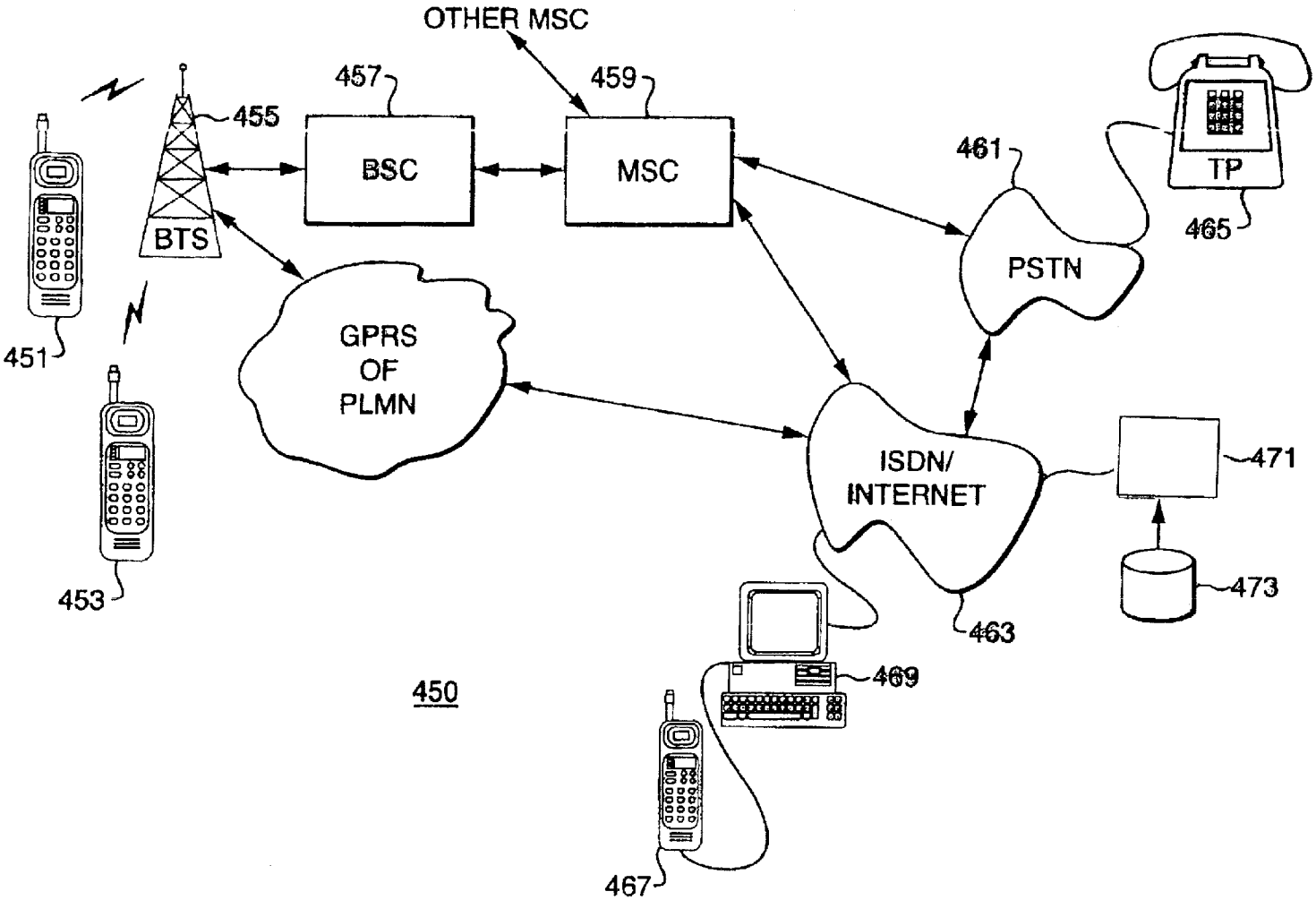
FIG. 16 illustrates a system network architecture in which the invention embodiment is applied in the receiver terminal when it streams or receives audio data over the radio connection of FIG. 15.

FIG. 16 presents an audio information transfer and audio download and/or streaming system 450 according to the invention, which system comprises mobile phones 451 and 453, a base transceiver station 455 (BTS), a base station controller (BSC) 457, a mobile switching center 459 (MSC), telecommunication networks 461 and 463, and user terminals 465 and 467, interconnected either directly or over a terminal device, such as a computer 469. In addition, there may be provided a server unit 471 which includes a central processing unit, memory, and a database 473, as well as a connection to a telecommunication network, such as the internet, an ISDN network, or any other telecommunication network that is in connection either directly or indirectly to the network into which the terminal having the decoder, including the beat detector of the invention, is capable of being connected either wirelessly or via a wired line connection. In audio data transfer system, according to the invention, the mobile stations and the server are point-to-point connected, and the user of the terminal 451 has a terminal including the beat detector in its decoder of the receiver, as shown in FIG. 15. The user of the terminal 451 selects audio data, such as a short interval of music or a short video with audio music, for downloading to the terminal. In the select request from the user, the terminal address is known to the server 473 and the detailed information of the requested audio data (or multimedia data) in such detail that the requested information can be downloaded. The server 471 then downloads the requested information to the other connection end, or if connectionless protocols are used between the terminal 451 and the server 471, the requested information is transferred by using a connectionless connection in such a way that recipient identification of the terminal is attached to the sent information. When the terminal 451 receives the audio data as requested, it could be streamed and played in the loudspeaker of the receiver terminal in which the error concealment is achieved by applying the beat detection in accordance with one embodiment of the invention.

The above is a description of the realization of the invention and its embodiments utilizing examples. It should be self-evident to a person skilled in the relevant art that the invention is not limited to the details of the above presented examples, and that the invention can also be realized in other embodiments without deviating from the characteristics of the invention. Thus, the possibilities to realize and use the invention are limited only by the claims, and by the equivalent embodiments which are included in the scope of the invention.

What is claimed is:

1. A method for concealing errors detected in an input digital audio bit stream, the audio bit stream configured as a series of frames, said method comprising the steps of:

detecting a first beat and a subsequent plurality of beats in the audio bit stream;

defining a first inter-beat interval extending between said first beat and a $(k+1)^{th}$ subsequent beat;

storing at least a portion of the audio bit stream occurring within said first inter-beat interval;

detecting an erroneous audio segment occurring in a second inter-beat interval extending between said $(k+1)^{th}$ beat and a $(2k+1)^{th}$ subsequent beat; and replacing at least a first part of said erroneous audio segment with a corresponding part of said stored audio bit stream portion, wherein the corresponding part is selected based on a time relationship between the first part and one of the $(k+1)^{th}$ and $(2k+1)^{th}$ beats.

2. A method as in claim 1 wherein 'k' is an integer greater than or equal to 2.

3. A method as in claim 1 wherein said stored audio bit stream portion includes at least one frame positioned on at least one of said beats.

4. A method as in claim 1 wherein said step of detecting a first beat comprises a step of computing the variance of the audio bit stream using decoded IMDCT coefficients.

5. A method as in claim 1 wherein said step of detecting a first beat comprises a step of utilizing a window-switching pattern.

6. A method as in claim 1 wherein said step of detecting a first beat comprises a step of computing the envelope of the audio bit stream using decoded IMDCT coefficients.

7. A method as in claim 1 wherein said step of detecting a first beat comprises steps of computing the variance of the audio bit stream using decoded IMDCT coefficients and utilizing a window-switching pattern.

8. A method as in claim 1 wherein said step of storing at least a portion of the audio bit stream includes a step of storing said portion in a circular first-in first-out (FIFO) buffer.

9. A method as in claim 1 wherein the audio bit stream includes a music signal.

10. A method as in claim 1 wherein the erroneous audio segment is the result of at least one of a packet loss from an IP network and a burst error from a wireless channel.

11. A method as in claim 1 further comprising the step of replacing one beat with another beat from a preceding bar.

12. A method as in claim 1, wherein the first part has a time displacement $\tau$ from one of the $(k+1)^{th}$ and $(2k+1)^{th}$ beats, and wherein the corresponding part is selected so as to have the same time displacement $\tau$ from one of the first and $(k+1)^{th}$ beats.

13. A method as in claim 1, further comprising:

determining a confidence score, the confidence score being a percentage of correct beat detection within an observation window; and discontinuing said replacing step when the confidence score is below a threshold value.

14. A method as in claim 1, further comprising estimating an inter-beat interval according to the formula $$IBI_i = IBI_{i-1} * (1-\alpha) + IBI_{new} * \alpha,$$

wherein $IBI_i$ is a current estimation of the inter-beat interval, $IBI_{i-1}$ is a previous estimation of the inter-beat interval, $IBI_{new}$ is a most recently-detected inter-beat interval, and $\alpha$ is a weighting parameter.

15. A method as in claim 1, wherein said storing comprises minimizing storage requirements by only storing frames adjacent to a strong beat or to an offbeat.

16. A method as in claim 1, further comprising replacing a corrupted audio frame by interpolating preceding and succeeding audio frames.

17. A method as in claim 1, further comprising replacing a second part of the erroneous audio segment preceding the first part of the erroneous audio segment with a frame preceding the second part.

18. A method as in claim 1, further comprising replacing a second part of the erroneous audio segment following the first part of the erroneous audio segment with a frame following the second part.

19. A method as in claim 1, further comprising:

replacing a second part of the erroneous audio segment preceding the first part of the erroneous audio segment with a frame preceding the second part; and replacing a third part of the erroneous audio segment following the first part of the erroneous audio segment with a frame following the third part.

20. A method as in claim 5, wherein said detecting a first beat and a subsequent plurality of beats further comprises:

detecting strong beats and off-beats, and determining an interval between strong beats based on a statistical probability of inter-beat intervals.

21. A method as in claim 20, wherein said detecting a first beat and a subsequent plurality of beats further comprises:

determining the interval between strong beats based on a most probable inter-beat interval of approximately 600 ms.

22. A wireless terminal comprising:

a receiver section having a beat detector and an audio decoder, wherein the receiver section is configured to perform steps comprising detecting a first beat and a subsequent plurality of beats in an audio bit stream, defining a first inter-beat interval extending between said first beat and a $(k+1)^{th}$ subsequent beat, storing at least a portion of the audio bit stream occurring within said first inter-beat interval, detecting an erroneous audio segment occurring in a second inter-beat interval extending between said $(k+1)^{th}$ beat and a $(2k+1)^{th}$ subsequent beat, and replacing at least a first part of said erroneous audio segment with a corresponding part of said stored audio bit stream portion, wherein the corresponding part is selected based on a time relationship between the first part and one of the $(k+1)^{th}$ and $(2k+1)^{th}$ beats.

23. The wireless terminal of claim 22, wherein 'k' is an integer greater than or equal to 2.

24. The wireless terminal of claim 22, wherein said stored audio bit stream portion includes at least one frame positioned on at least one of said beats.

25. The wireless terminal of claim 22, wherein said step of detecting a first beat comprises a step of computing the variance of the audio bit stream using decoded IMDCT coefficients.

26. The wireless terminal of claim 22, wherein said step of detecting a first beat comprises the step of utilizing a window-switching pattern.

27. The wireless terminal of claim 22, wherein said step of detecting a first beat comprises a step of computing the envelope of the audio bit stream using decoded IMDCT coefficients.

28. The wireless terminal of claim 22, wherein said step of detecting a first beat comprises steps of computing the variance of the audio bit stream using decoded IMDCT coefficients and utilizing a window-switching pattern.

29. The wireless terminal of claim 22, wherein said step of storing at least a portion of the audio bit stream includes a step of storing said portion in a circular first-in first-out (FIFO) buffer.

30. The wireless terminal of claim 22, wherein the audio bit stream includes a music signal.

31. The wireless terminal of claim 22, wherein the erroneous audio segment is the result of at least one of a frame loss from an IP network and a burst error from a wireless channel.

32. The wireless terminal of claim 22, wherein the first part has a time displacement $\tau$ from one of the $(k+1)^{th}$ and $(2k+1)^{th}$ beats, and wherein the corresponding part is selected so as to have the same time displacement $\tau$ from one of the first and $(k+1)^{th}$ beats.

33. The wireless terminal of claim 22, wherein the receiver section is configured to perform steps comprising:

determining a confidence score, the confidence score being a percentage of correct beat detection within an observation window, and discontinuing said replacing step when the confidence score is below a threshold value.

34. The wireless terminal of claim 22, wherein the receiver section is configured to perform steps comprising:

estimating an inter-beat interval according to the formula $$IBI_i = IBI_{i-1} * (1-\alpha) + IBI_{new} * \alpha,$$

wherein $IBI_i$ is a current estimation of the inter-beat interval, $IBI_{i-1}$ is a previous estimation of the inter-beat interval, $IBI_{new}$ is a most recently-detected inter-beat interval, and $\alpha$ is a weighting parameter.

35. The wireless terminal of claim 22, wherein said storing comprises minimizing storage requirements by only storing frames adjacent to a strong beat or to an offbeat.

36. The wireless terminal of claim 22, wherein the receiver section is configured to perform steps comprising:

replacing a corrupted audio frame by interpolating preceding and succeeding audio frames.

37. The wireless terminal of claim 22, wherein the receiver section is configured to perform steps comprising:

replacing a second part of the erroneous audio segment preceding the first part of the erroneous audio segment with a frame preceding the second part.

38. The wireless terminal of claim 22, wherein the receiver section is configured to perform steps comprising:

replacing a second part of the erroneous audio segment following the first part of the erroneous audio segment with a frame following the second part.

39. The wireless terminal of claim 22, wherein the receiver section is configured to perform steps comprising:

replacing a second part of the erroneous audio segment preceding the first part of the erroneous audio segment with a frame preceding the second part, and replacing a third part of the erroneous audio segment following the first part of the erroneous audio segment with a frame following the third part.

40. The wireless terminal of claim 26, wherein said detecting a first beat and a subsequent plurality of beats further comprises:

detecting strong beats and off-beats, and determining an interval between strong beats based on a statistical probability of inter-beat intervals.

41. The wireless terminal of claim 40, wherein said detecting a first beat and a subsequent plurality of beats further comprises:

determining the interval between strong beats based on a most probable inter-beat interval of approximately 600 ms.

42. The wireless terminal of claim 22, wherein the receiver section is configured to perform the step of replacing one beat with another beat from a preceding bar.

* * * * *

UNITED STATES PATENT AND TRADEMARK OFFICE

CERTIFICATE OF CORRECTION

PATENT NO. : 7,069,208 B2
APPLICATION NO. : 09/770113
DATED : June 27, 2006
INVENTOR(S) : Ye Wang It is certified that error appears in the above-identified patent and that said Letters Patent is hereby corrected as shown below:

On Title page, item 56 under Other Publications, 11th reference:
"http://ccma-www.stanford.edu/bosse/proj/node27.html" has been replaced with
--http://ccrma-www.stanford.edu/~bosse/proj/node27.html--

On Title page, item 56 under Other Publications, 12th reference:
"http://www.lis.fhg.de/amm/techint/layer3/index.html" has been replaced with
--http://www.iis.fhg.de/amm/techinf/layer3/index.html--

On Title page, item 56 under Other Publications, 29th reference:
"Lapped Transform" has been replaced with --Lapped Transforms for Transform--

Signed and Sealed this

Twenty-third Day of January, 2007

JON W. DUDAS
*Director of the United States Patent and Trademark Office*